US006802746B2

(12) United States Patent
Carranza

(10) Patent No.: US 6,802,746 B2
(45) Date of Patent: Oct. 12, 2004

(54) ELECTRICAL CONNECTOR WITH TERMINAL POSITION ASSURANCE SYSTEM

(75) Inventor: Magdalena M. Carranza, Wheaton, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/316,748

(22) Filed: Dec. 11, 2002

(65) Prior Publication Data

US 2004/0115996 A1 Jun. 17, 2004

(51) Int. Cl.[7] ..... H01R 13/514
(52) U.S. Cl. ..... 439/752; 439/284; 439/701
(58) Field of Search ..... 439/752, 284, 439/287, 701, 597

(56) References Cited

U.S. PATENT DOCUMENTS 4,772,229 A 9/1988 Nix et al. ..... 439/733
5,160,283 A 11/1992 Fry et al. ..... 439/752
5,288,250 A * 2/1994 Sumida ..... 439/701
5,643,015 A * 7/1997 Wakata ..... 439/701
5,647,775 A 7/1997 Polgar et al. ..... 439/752
6,450,829 B1 9/2002 Weisz-Margulescu ..... 439/352
6,645,003 B2 * 11/2003 Yoshida et al. ..... 439/507

* cited by examiner

*Primary Examiner*—Hae Moon Hyeon
(74) *Attorney, Agent, or Firm*—Stephen Z. Weiss

(57) ABSTRACT

An electrical connector assembly includes a connector housing having a pair of interconnectable housing portions. Each housing portion has a terminal-receiving passage with a conductive terminal inserted thereinto. An opening in each housing portion communicates with the respective terminal-receiving passage thereof. A locking projection on each housing portion is insertable into the opening of the other housing portion to a position preventing withdrawal of the terminal of the other housing portion when the housing portions are interconnected.

12 Claims, 4 Drawing Sheets

ELECTRICAL CONNECTOR WITH TERMINAL POSITION ASSURANCE SYSTEM

FIELD OF THE INVENTION

This invention generally relates to the art of electrical connectors and, particularly, to an electrical connector assembly which incorporates an improved terminal position assurance (TPA) system that not only detects an incompletely inserted terminal but also locks a properly inserted terminal in its fully inserted position.

BACKGROUND OF THE INVENTION

Generally, an electrical connector includes a dielectric housing mounting at least one electrically conductive terminal. The terminal is electrically connected to another circuit component, such as a discrete electrical wire. Connectors often are employed in mateable pairs such that each terminal and the housing of one connector are mateable with a corresponding terminal and the housing of a complementary mating connector.

Electrical connector assemblies are used in a wide variety of applications where it is necessarily to electrically interconnect a plurality of electrical wires to perform various functions. The terminals of electrical connectors frequently are small components, such as terminals that are stamped and/or formed from thin sheet metal material. A poor quality electrical connection may occur if one (or more) terminal is not properly seated in its respective housing. The improper seating of a terminal in a housing may occur if the terminal is not fully inserted into the housing during the initial assembly of the connector or if the terminal is vibrated or pulled out of its fully seated condition during use of the connector. A pulling force on an electrical wire secured to a terminal may cause a temporary break in the electrical contact between the terminal and another terminal of the mating connector.

More severe pulling forces on the electrical wire and/or the terminal may cause a partial or complete disconnection. In either event, even a momentary break in the electrical connection may result in spurious operation of an electrically driven device or an electrical circuit associated with the connector. Consequently, various locking structures have been used to lock terminals in their respective connector housings. Typically, the locking structure may include resilient tangs or latch projections which engage shoulders on the connector housing. Unfortunately, such resilient tangs or latch projections are prone to breakage. In addition, they do not detect or indicate whether or not a terminal is fully inserted and seated in the connector housing.

To avoid these problems, it often is required to provide connectors with some form of a terminal position assurance (TPA) system to detect incomplete insertion of the terminals. In some applications, the TPA system or device also performs the function of locking the terminals in the connector housing.

Heretofore, many TPA systems use separate TPA "keys" which arc insertable into openings in the connector housing to detect full insertion of the terminals and to lock the terminals in their fully inserted positions. For dual row connector designs, a pair of TPA keys may be required. Such TPA keys create problems in that they require additional and costly manufacture and assembly. Separate TPA keys require additional components to be held in inventory. In addition, such TPA keys are prone to be lost or misplaced. Even if the TPA keys are tethered to the housing, such as by a living hinge, such TPA keys often are broken off from the tether or otherwise damaged. Regardless of whether the TPA keys are separate or tethered, they are inserted into the connector housing through an opening in the outer housing surface. These openings create further problems in electrical leakage and also may be dangerous for an operator during assembly and use.

The present invention is directed to solving this myriad of problems by providing a unique TPA system which employs totally internal components within a multi-part connector housing.

SUMMARY OF THE INVENTION

An object, therefore, of the invention is to provide an electrical connector assembly with a new and improved terminal position assurance (TPA) system.

In the exemplary embodiment of the invention, the electrical connector assembly includes a connector housing having a pair of interconnectable housing portions. Each housing portion has a terminal-receiving passage. A conductive terminal is inserted into the passage of each housing portion. An opening is provided in each housing portion communicating with the respective terminal-receiving passage thereof. A locking projection on each housing portion is insertable into the opening of the other housing portion to a position preventing withdrawal of the terminal of the other housing portion when the housing portions are interconnected.

As disclosed herein, the housing portions are hermaphroditic. Each housing portion has a pair of the openings on opposite sides of the respective terminal for receiving a pair of the locking projections of the other housing portion in positions on opposite sides of the terminal preventing withdrawal thereof.

According to one aspect of the invention, each housing portion includes a flexible locking arm adjacent the opening in the respective housing portion. The flexible locking arm is engageable with a locking shoulder on the respective terminal. The locking projection on the other housing portion is insertable to a position behind the flexible locking arm to prevent the locking arm from moving out of engagement with the locking shoulder on the respective terminal.

According to another aspect of the invention, the terminal in each housing portion includes a locking shoulder. The locking projection of the other housing portion is insertable to a position behind the locking shoulder to prevent withdrawal of the respective terminal.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
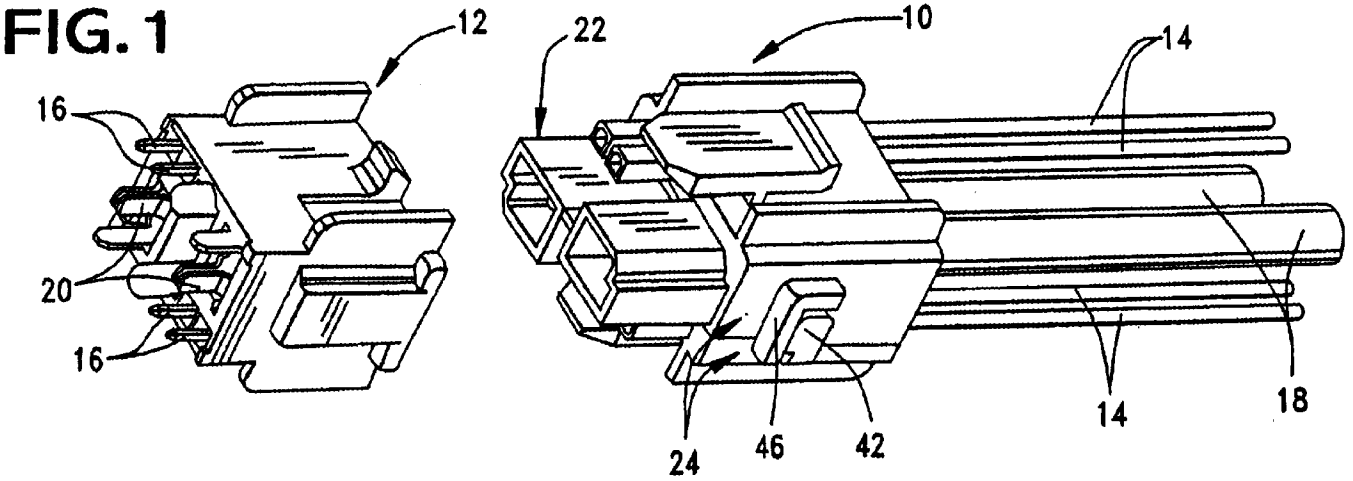
FIG. 1 is a perspective view of an electrical connector assembly according to the invention in conjunction with a complementary mating connector.
Figure 2:
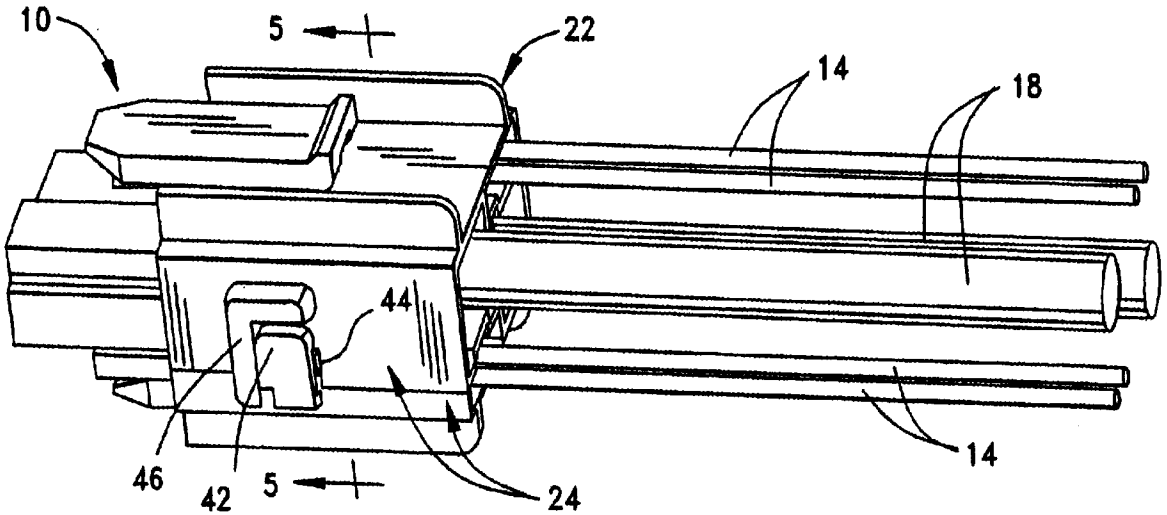
FIG. 2 is a perspective view of the connector assembly according to the invention, taken at a different angle from that of FIG. 1.

Referring to the drawings in greater detail and first to FIGS. 1 and 2, the invention is embodied in an electrical connector assembly, generally designated 10, which is mateable with a complementary mating connector, generally designated 12. Connector assembly 10 terminates two pairs of signal wires or conductors 14 which are terminated to respective terminals (not visible in FIGS. 1 and 2) which electrically engage two pairs of signal terminals 16 mounted within mating connector 12. Connector assembly 10 also terminates a pair of power wires or conductors 18 which are terminated to respective terminals (not visible in FIGS. 1 and 2) within connector assembly 10 and which electrically engage a pair of power terminals 20 mounted within mating connector 12.

Figure 3:
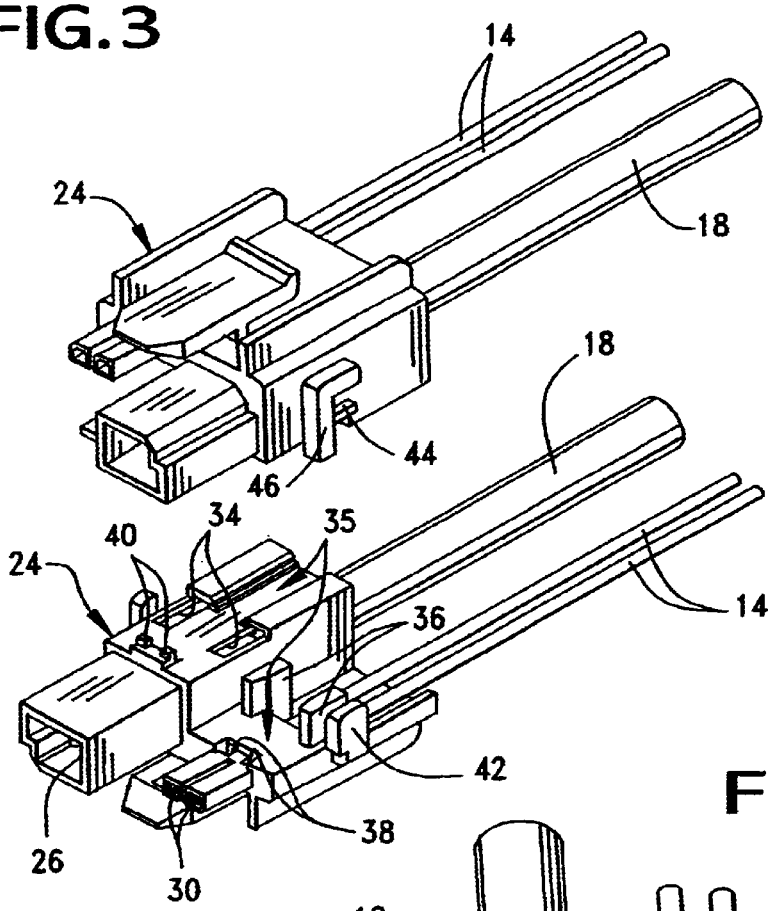
FIG. 3 is a perspective view of the two housing portions of the connector assembly disconnected from the assembled condition of FIGS. 1 and 2.

Referring to FIG. 3 in conjunction with FIGS. 1 and 2, connector assembly 10 includes a dielectric composite housing, generally designated 22 (FIGS. 1 and 2), which is defined by a pair of interconnectable housing portions, generally designated 24. As will be seen hereinafter, each housing portion 24 mounts respective terminals for termination to one of the pair of signal wires 14 and one of the pair of power wires 18. In the preferred embodiment of the invention disclosed herein, housing portions 14 are hermaphroditic.

Figure 4:
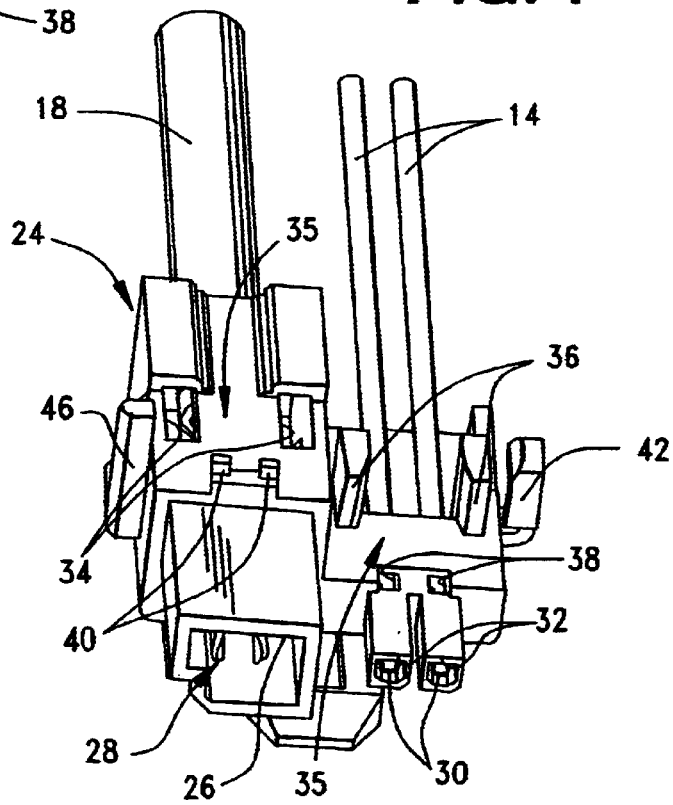
FIG. 4 is a perspective view of one of the housing portions taken at a different angle from that of FIG. 3.

With that understanding that housing portions 24 are hermaphroditic or substantially identical, only one of the housing portions will be described at this point, with particular reference to FIG. 4 in conjunction with FIG. 3. Specifically, each housing portion 24 includes a terminal-receiving passage 26 for receiving a power terminal, generally designated 28 and described in greater detail hereinafter, which is terminated to one of the power wires 18. Each housing portion 24 is unitarily molded of dielectric material such as plastic or the like. The housing portion includes a pair of terminal-receiving passages 30 within which are mounted a pair of signal terminals, generally designated 32 and described in greater detail hereafter, which are terminated to one of the pair of signal wires 14. Each housing portion has an interconnecting face 35 with a pair of openings 34, which communicate with terminal-receiving passage 26 at opposite sides thereof, and a pair of locking projections 36 insertable into openings 34 of the other housing portion. In addition, the interconnecting face 35 of each housing portion has a pair of openings 38 communicating respectively with the pair of terminal-receiving passages 30 and a pair of locking projections 40 insertable into openings 38 of the other housing portion. Finally, each housing portion includes a flexible latch arm 42 on one side thereof and a latch boss 44 (FIG. 3) on the opposite side thereof. The latch boss is located within an L-shaped protective should 46. The flexible latch arms and latch bosses will be described in greater detail hereinafter. Suffice it to say, the latch arm 42 of each housing portion is engageable with the latch boss 44 of the other housing portion in a hermaphroditic manner to latch and interconnect the housing portions and to define the composite housing 22 as seen in FIGS. 1 and 2.

Figure 5:
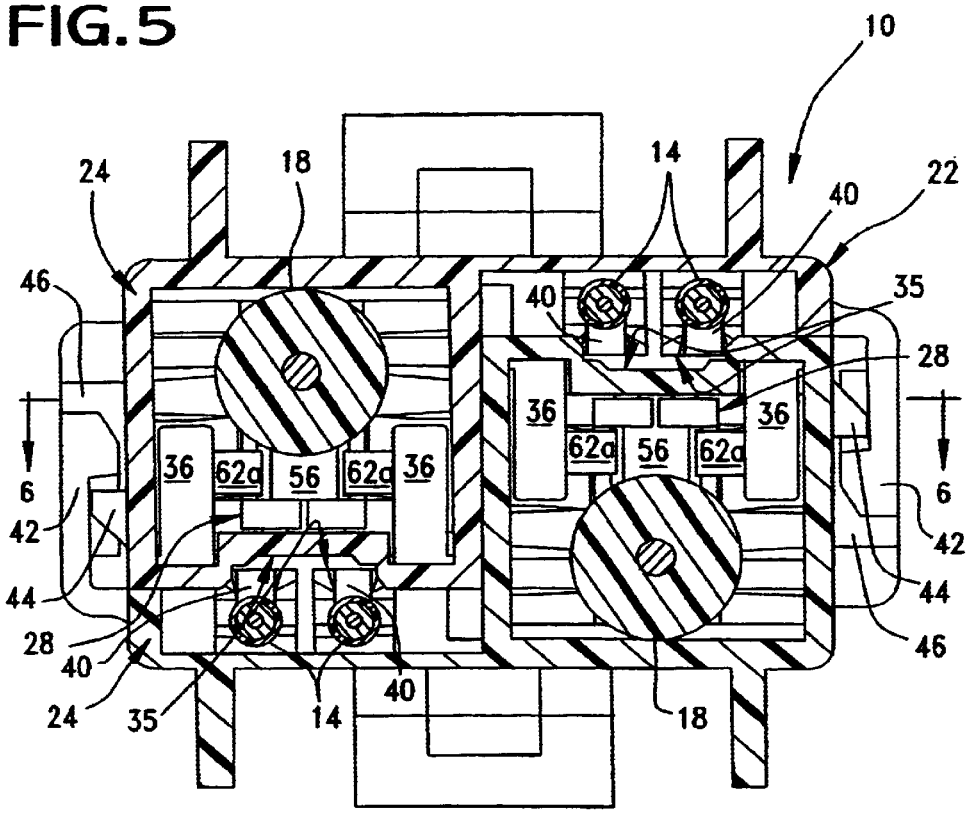
FIG. 5 is a vertical section taken generally along line 5—5 of FIG. 2.
Figure 6:
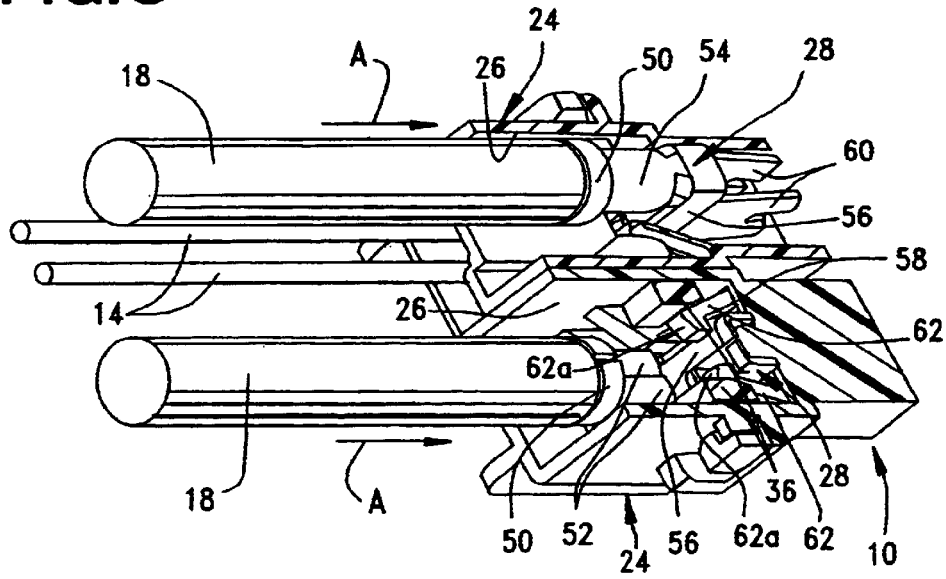
FIG. 6 is a horizontal section taken generally along line 6—6 of FIG. 5.

Referring to FIGS. 5 and 6, and particularly to FIG. 6, each power terminal 28 includes a crimp portion 50 which is crimped onto the outer dielectric cladding of the respective power wire 18. The internal conductors 52 of the power wire are appropriately connected, as by soldering, to a base portion 54 of the power terminal. Each terminal also includes an upstanding or transversely oriented head portion 56 which abuts an internal shoulder 58 of housing portion 24 when the terminal and power wire are fully inserted and seated into terminal-receiving passage 26. Each power terminal has a bifurcated contact end 60 for engaging one of the power terminals 20 (FIG. 1) of mating connector 12.

Still referring to FIGS. 5 and 6 and particularly FIG. 6, each housing portion 26 has a pair of flexible, hooked locking arms 62 which lockingly engage head portion 56 of the respective power terminal 28. Power wires 18, with power terminals 28 terminated thereto, are inserted into terminal-receiving passages 24 of housing portions 24 in the direction of arrows "A" (FIG. 6). During insertion, head portions 56 of the power terminals engage chamfered front ends 62*a* of locking arms 62 to spread the flexible locking arms outwardly until head portions 56 engage shoulders 58 of the housing portions. In this fully inserted or seated positions of the power terminals, flexible locking arms 62 snap back inwardly into locking positions as shown clearly in FIG. 6.

Still referring to FIGS. 5 and 6, when the two hermaphroditic housing portions 24 are assembled or interconnected, locking projections 36 (FIG. 4) of each housing portion enter openings 34 of the other housing portion. When the housing portions are fully interconnected, locking projections 36 move into positions behind flexible locking arms 62 as seen in FIG. 6. Therefore, the flexible locking arms cannot flex outwardly out of engagement with head portions 56 of power terminals 28. Consequently, locking projections 36 positively lock the terminals within the housing portions. In addition, should one of the power terminals 28 not be fully seated against the respective shoulder 58 of the housing portion, locking arms 62 will remain biased to outwardly spread positions. As a result, locking projections 56 cannot be moved completely into openings 34 because locking arms 62 will block movement of the locking projections. Consequently, this will indicate or detect an incomplete insertion of that respective power terminal.

Figure 7:
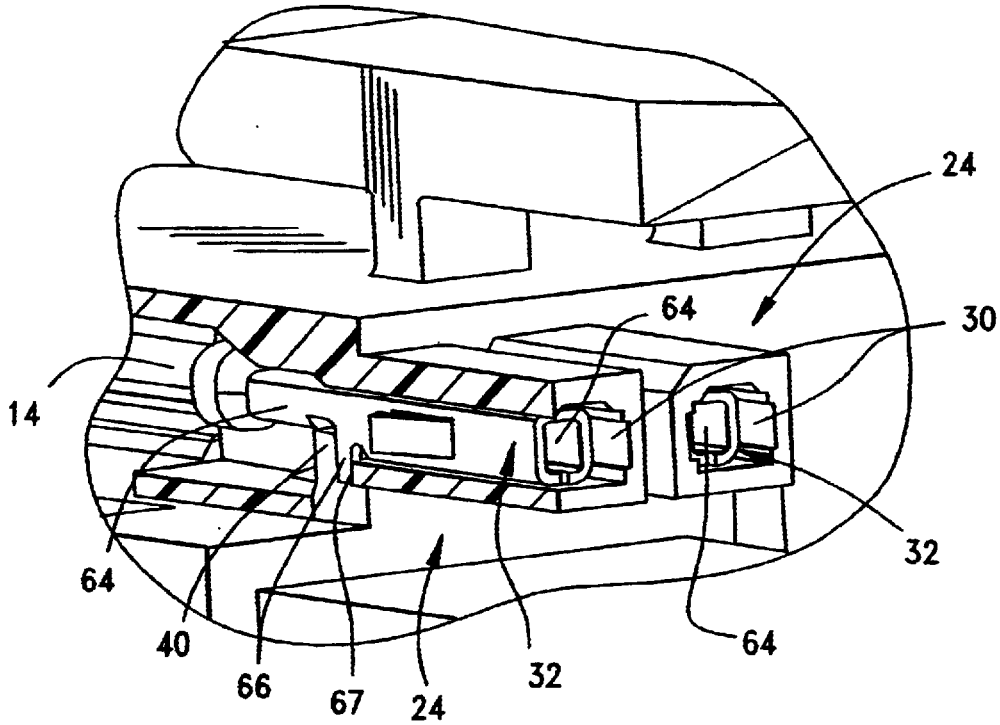
FIG. 7 is an exploded, fragmented perspective view of the TPA system for the signal terminals.

Referring to FIG. 7 in conjunction with FIG. 5, a pair of the signal terminals 32 are shown in their respective terminal-receiving passages 30 in one of the housing portions 24. Each signal terminal 32 has a crimp portion 64 crimped to a respective one of the signal wires 14. A front socket contact portion 64 of each signal terminal receives one of the signal terminals 16 (FIG. 1) of mating connector 12. Each signal terminal also includes a locking shoulder 66 extending transversely outwardly therefrom. Locking shoulder 66 seats against a stop shoulder 67 on the respective housing portion to define a fully inserted position of the respective signal terminal. As clearly seen in FIG. 7, one of the locking projections 40 (also see FIG. 4) of the other housing portion 24 is shown positioned behind locking shoulder 66 of the signal terminal 32. This is the condition when the two hermaphroditic housing portions are fully assembled or interconnected. In other words, during assembly, locking projections 40 of one housing portion moves into openings 38 in the other housing portion and into positions behind locking shoulders 66 of the signal terminals as seen in FIG. 7. Due to the configuration of the signal terminals, if one of the signal terminals is not fully inserted to its seated position, the respective locking projections will abut against the front socket portion 64 of the terminal whereupon the two housing portions cannot be fully engaged, thereby indicating or detecting the incorrect terminal position of that signal terminal.

Figure 8:
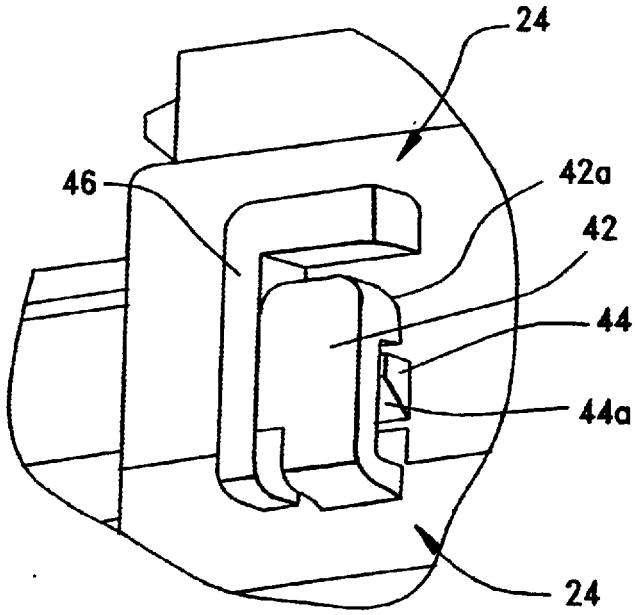
FIG. 8 is an enlarged, fragmented perspective view of one of the latches between the housing portions at each opposite side of the connector assembly.

Referring to FIG. 8 in conjunction with FIGS. 2 and 5, it can be seen how each flexible latch arm 42 on each housing portion interengages the respective latch boss 44 of the other housing portion within L-shaped protective shroud 46. During assembly or interconnection of the housing portions, a leading edge 42*a* of flexible latch arm 42 engages an angled or chamfered edge 44*a* of latch boss 44, whereupon the flexible latch arm moves outwardly and then snaps back inwardly into latching engagement with the respective latch boss.

It will be understood that the invention maybe embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector assembly, comprising:

a connector housing including a pair of interconnectable housing portions, with each housing portion having a terminal-receiving passage and an interconnecting face, the interconnecting face of each housing portion of the pair being opposite one another when the housing portions are interconnected;

a conductive terminal inserted into the passage of each housing portion;

an opening in the interconnecting face of each housing portion communicating with the respective terminal-receiving passage thereof; and a locking projection on the interconnecting face of each housing portion insertable into the opening of the other housing portion to a position preventing withdrawal of the terminal of the other housing portion when the housing portions are interconnected.

2. The electrical connector assembly of claim 1 wherein said housing portions are hermaphroditic.

3. The electrical connector assembly of claim 1 wherein each housing portion has a pair of said openings on opposite sides of the respective terminal for receiving a pair of said locking projections of the other housing portion in positions on opposite sides of the terminal preventing withdrawal thereof.

4. The electrical connector assembly of claim 1 wherein each housing portion includes a flexible locking arm adjacent the opening in the respective housing portion, the flexible locking arm being engageable with a locking shoulder on the respective terminal, and the locking projection on the other housing portion being insertable to a position behind the flexible locking arm to prevent the locking arm from moving out of engagement with the locking shoulder on the respective terminal.

5. The electrical connector assembly of claim 1 wherein the terminal in each housing portion includes a locking shoulder, and the locking projection of the other housing portion is insertable to a position behind said locking shoulder to prevent withdrawal of the respective terminal.

6. The electrical connector assembly of claim 1 wherein said interconnectable housing portions include complementary interengaging latch means to hold the housing portions in assembly.

7. The electrical connector assembly of claim 6 wherein said latch means include a flexible latch arm on each housing portion interengageable with a latch boss on the other housing portion.

8. An electrical connector assembly, comprising:

a connector housing including a pair of interconnectable hermaphroditic housing portions, each housing portion having a terminal-receiving passage;

a conductive terminal inserted into the passage of each housing portion, the terminal having a locking shoulder;

an opening in each housing portion communicating with the respective terminal-receiving passage thereof;

a flexible locking arm on each housing portion adjacent the opening in the respective housing portion and engageable with the locking shoulder on the respective terminal; and a locking projection on each housing portion insertable into the opening of the other housing portion to a position behind the flexible locking arm to prevent the locking arm from moving out of engagement with the locking shoulder on the respective terminal when the housing portions are interconnected.

9. The electrical connector assembly of claim 8 wherein each housing portion has a pair of said openings on opposite sides of the respective terminal for receiving a pair of said locking projections of the other housing portion in positions behind a pair of said flexible locking arms on opposite sides of the terminal preventing withdrawal thereof.

10. An electrical connector assembly, comprising:

a connector housing including a pair of interconnectable housing portions, with each housing portion having a terminal-receiving passage and an interconnecting face, the interconnecting face of each housing portion of the pair being opposite one another when the housing portions are interconnected;

a conductive terminal inserted into the passage of each housing portion, the terminal having a locking shoulder;

an opening in the interconnecting face of each housing portion communicating with the respective terminal-receiving passage thereof; and a locking projection on the interconnecting face of each housing portion insertable into the opening of the other housing portion to a position behind said locking shoulder to prevent withdrawal of the respective terminal when the housing portions are interconnected.

11. The electrical connector assembly of claim 10 wherein each housing portion has a pair of said openings on opposite sides of the respective terminal for receiving a pair of said locking projections of the other housing portion in positions on opposite sides of the terminal preventing withdrawal thereof.

12. An electrical connector assembly, comprising:

a connector housing including a pair of interconnectable housing portions, with each housing portion having a terminal-receiving passage;

a conductive terminal inserted into the passage of each housing portion;

an opening in each housing portion communicating with the respective terminal-receiving passage thereof;

a locking projection on each housing portion insertable into the opening of the other housing portion to a position preventing withdrawal of the terminal of the other housing portion when the housing portions are interconnected; and each housing portion further including a flexible locking arm adjacent the opening in the respective housing portion, the flexible locking arm being engageable with a locking shoulder on the respective terminal, and the locking projection on the other housing portion being insertable to a position behind the flexible locking arm to prevent the locking arm from moving out of engagement with the locking shoulder on the respective terminal.

* * * * *